United States Patent [19]

Menzel et al.

[11] 3,949,441

[45] Apr. 13, 1976

[54] SHALLOW WATER MOORED BUOY

[75] Inventors: Harry R. Menzel, Hatboro; Joseph F. Belzer, Southampton, both of Pa.

[73] Assignee: The United States of America as represented by the Secretary of the Navy, Washington, D.C.

[22] Filed: July 23, 1975

[21] Appl. No.: 598,495

[52] U.S. Cl. ..... 9/8 R; 114/206 R

[51] Int. Cl.[2] ..... B63B 21/52

[58] Field of Search ..... 9/8 R, 9; 114/206 R; 340/2

[56] References Cited

UNITED STATES PATENTS

| | | | |
|---|---|---|---|
| 2,586,828 | 2/1952 | Keeran | 9/8 R |
| 3,287,753 | 11/1966 | Race | 9/8 R |
| 3,702,014 | 11/1972 | Rabon et al. | 9/9 |

*Primary Examiner*—Trygve M. Blix
*Assistant Examiner*—Gregory W. O'Connor
*Attorney, Agent, or Firm*—R. S. Sciascia; Henry Hansen; William J. Iseman

[57] ABSTRACT

A shallow water moored buoy having an anchor retaining mechanism on a bottom deck which automatically releases an anchor when the buoy strikes water. The buoy is filled with floatation material which encloses electronic and battery packages and has an antenna mounted on an upper deck and hydrophone sensors attached to a deployable anchor cable which is secured to the center of the bottom deck.

10 Claims, 4 Drawing Figures

16
10
12
18
13
13
14
27
19
22
20
26
25
21
24
22 a
23
32
34
36
28

SHALLOW WATER MOORED BUOY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to moored buoys and particularly to a moored buoy which is easily deployed within a shallow water body.

In operation it is desirable that a shallow water moored buoy be deployable by one man from over the side of a small boat. The anchor and hydrophone cable should be capable of storage on the buoy and an anchor release mechanism provided which will automatically cause the buoy to assume a moored position. Prior art moored buoys which incorporate some or all of the foregoing structure have been relatively large in size and have utilized more expensive and sophisticated anchoring systems which provide difficulty in deployment.

SUMMARY OF THE INVENTION

Accordingly, it is an object of the present invention to provide a moored buoy which is capable of automatic deployment in a shallow water body, for example, of 100 to 1,000 feet deep. Another object of the invention is to provide for a relatively small size moored buoy having an anchoring system which is conveniently deployable. Yet another object of the present invention is to provide for stowage of anchoring and hydrophone cables upon the buoy while in the non-deployed position. Still another object of the present invention is to provide a shallow water moored buoy which contains electronics and battery packages and which is capable of sustained sensor operation for relatively long periods of time.

Briefly, these and other objects are accomplished by a relatively small size shallow water moored buoy having an anchor retaining mechanism which automatically releases an anchor when the buoy strikes water. The buoy is of such a size as to be deployable by one man from over the side of a small boat and incorporates electronics and battery packages, an antenna mount, a floatable housing having a cable spool for stowage of anchor and hydrophone cable, and an anchor. The buoy maintains buoyancy by enclosing a quantity of floatation material such as styrofoam within a shroud between an upper antenna deck and a lower anchor deck. The anchor retaining and release mechanism is automatically activated upon impact on the water by a pressure sensitive release plate which is hinged off-center to provide for disengagement of an anchor release pin upon initial water impact. Due to its weight, the anchor drops free from the bottom of the buoy thereby causing the anchor and hydrophone cable to unfurl from a spool arrangement wound about the outer periphery of the shroud. In operation, the hydrophone sensors are attached to the deployed hydrophone cable and, in combination with the electronics contained within the buoy, capably provide for shallow water detection of small ships or other pertinent data which is then transmitted to monitoring stations.

For a better understanding of these and other aspects of the invention, reference may be made to the following detailed description taken in conjunction with the accompanying drawings.

DESCRIPTION OF THE PREFERRED EMBODIMENT

Figure 1:
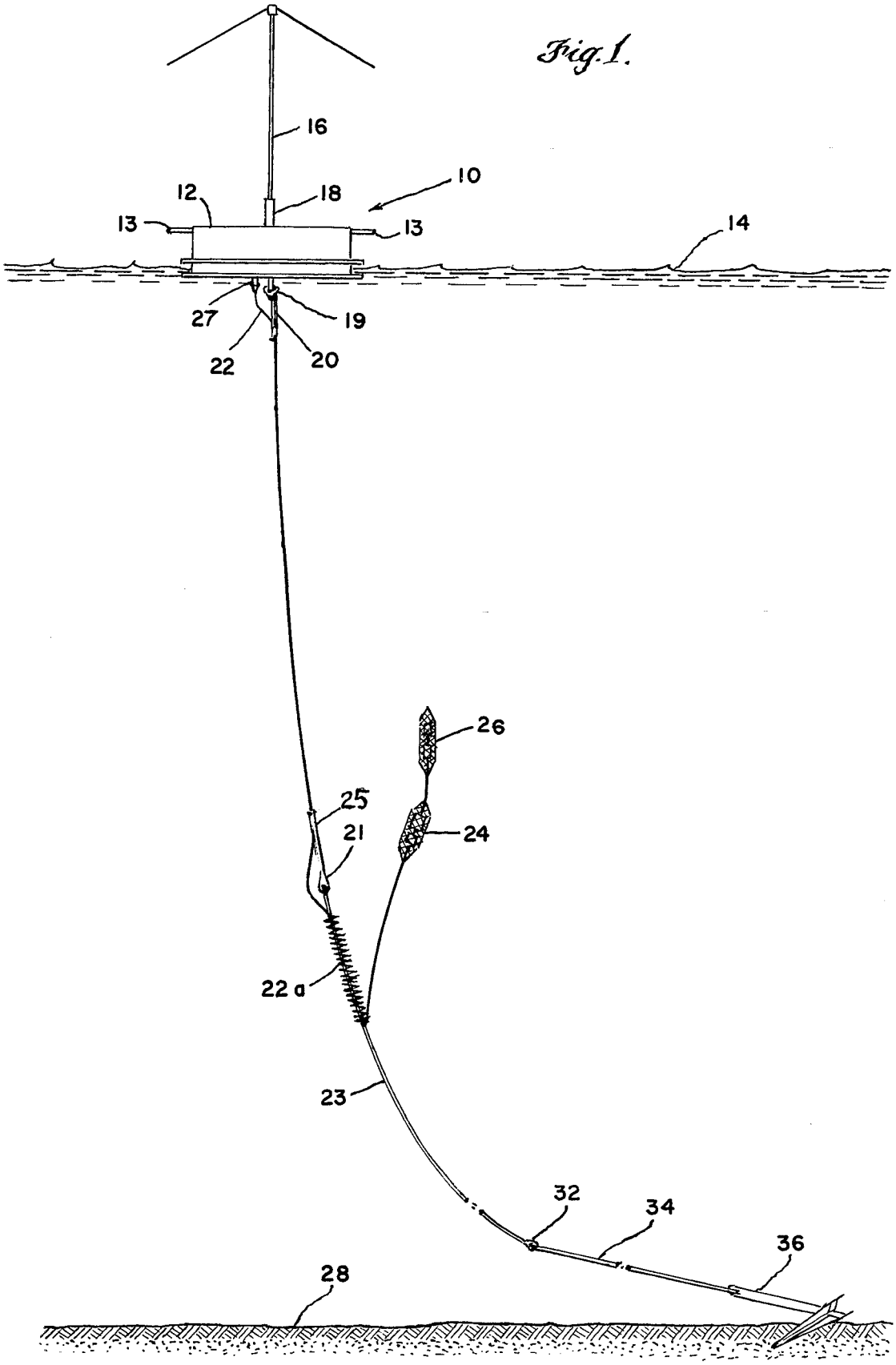
FIG. 1 is an illustration of the present invention shown in its deployed operating position.

Referring now to FIG. 1, there is shown a moored buoy sensor system 10 in the deployed position. A spool shroud 12 having diametrically opposed retrieving hooks 13 secured to its outer perimeter forms the main body of the buoy which is illustrated as floating on the top surface 14 of a shallow water body. The top of the buoy has an antenna 16 which is attached to an antenna support 18. A triple section cable is secured to the bottom of the buoy and serves to moor the buoy within the water body. The first section of the cable comprises a first constrictable nylon braid 20 which is secured at one end to the center of the bottom portion of the buoy at an anchor cable connection 19, a portion of a sensor cable 22, and a second constrictable nylon braid 25. A hydrophone cable connection 27 is attached to the bottom of the buoy and provides an electrical connection to the sensor cable 22 which is tied to the lower end of the braid 20 and which enters the braid at a convenient point near the cable connection 19 so as to be constricted within the braid 20 as the braid is tensed during deployment. The cable 22 continues downward to a first cable connector 21 near which point it is tied to and enters the second constrictable nylon braid 25 which is secured at the lower end to the connector 21. Cable 22 passes around the connector 21 so as to be formed in a helix **22*a* about the second section 23 of the triple section cable. After being helically wound about the second section 23 of the cable, the helix 22*a* is discontinued and the sensor cable 22 is connected to a hydrophone package 24 which is enclosed in any convenient manner such as a nylon mesh bag. A second nylon mesh bag containing float material 26 such as styrafoam is attached to the hydrophone package 24 in order to insure that the hydrophones assume a floating position within the water body and not, as is possible in some situations, to lie on the bottom 28 of the water body. The second cable section 23 is preferably formed from an elastic material such as rubber which will absorb some of the cable stresses which might be transmitted to the hydrophone package as unwanted noise. Similarly, the helix 22*a* is used to absorb stresses in the hydrophone cable. The second section 23 of the cable terminates at a second cable connector 32 which is also secured to the third section 34 of the cable which may be comprised, for example, of a metallic material. The metallic material is preferred for its strength and durability inasmuch as it is possible in some situations that the bottommost portion of the cable may become snagged or entangled in rock-like formations or other sharp surfaces found on the bottom 28 of the water body. The end of the third section 34 of the cable is terminated in a conventional anchor 36 which is designed to embed within the bottom 28 of the water body upon deployment. The individual lengths of each of the cable sections 22, 23 and 34** are dependent upon the depth of the water and for this reason some sections are shown in fragmented portions. In operation, the total length of the cable may be three times the depth of the water to ensure proper mooring.

Figure 2:
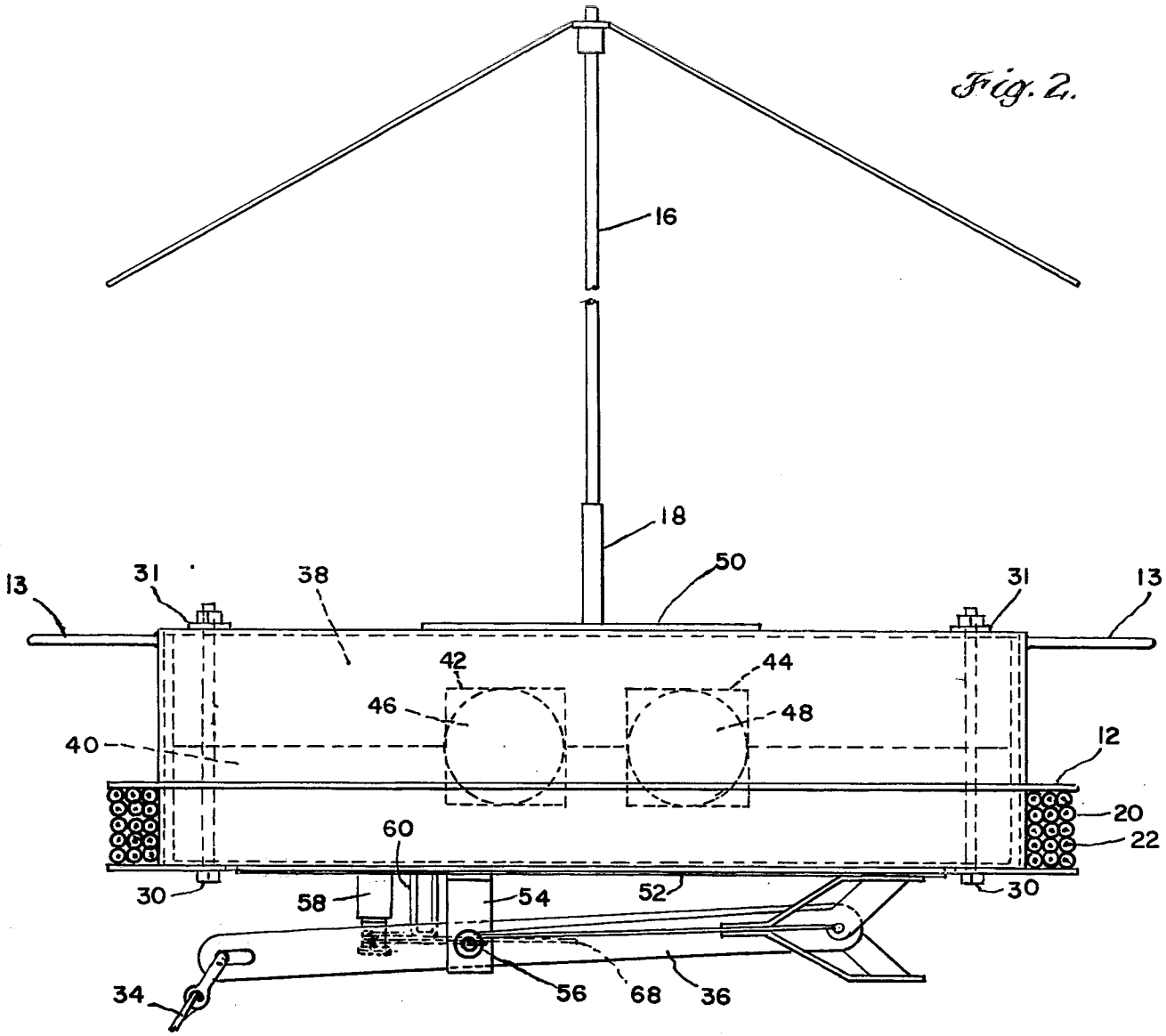
FIG. 2 is an elevational view of the present invention shown in a stowage position.

Referring now to FIG. 2, there is shown a side-elevational view of the moored buoy sensor system in the stowage The Th shroud spool 12 is now more clearly shown to be that of a container having a straight walled upper section and a bottom section formed into a spool wherein a portion of the triple section cable is shown in section wound about the spool with the first section 20 having the sensor cable 22 at the center thereof. In designing the size of the spool, of course, it is intended that the entire three sections of the cable be accommodated for stowage purposes. The hydrophone package 24 and the float material 26 are intended to be wound in sequence with the cable but during stowage these two items will extend somewhat beyond the outer periphery of the spool. The shroud spool 12 encases a quantity of floatation material such as styrofoam which is partitioned into an upper section 38 and a lower section 40 of approximately equal size and diameter and which are shaped to be in intimate contact with the confines of the shroud spool 12. Rectangular sections 42, 44 are hollowed out in equal depth from both the upper and lower sections 38, 40 of styrofoam so as to permit the encasing of a cylindrical electronics package 46 and a cylindrical battery package 48. The finished size of the hollowed out portions 42, 44 of the floatation material are intended to be sufficiently sized so as to permit adequate space for the encasing of the electronics and battery cylinders and at the same time to secure and support the cylinders. At the top of the upper section 38 of the floatation material and secured directly thereto in any convenient manner is an antenna deck 50 which is attached to the antenna support 18 and the corresponding antenna 16. It is to be noted that the shroud spool 12 is intended to be essentially an open cylinder so that the styrofoam sections 38, 40 will be in intimate contact with the inside of the shroud spool. The shroud spool 12 is not completely open at the bottom end, however, but rather provides an inwardly directed circular flange which serves to secure the bottom section 40 within the shroud spool 12. Both the shroud spool 12 and the styrofoam sections 38, 40 are then secured together by a bolt 30 and washer 31 arrangement mounted through the lower flange of the shroud spool. Secured to the bottom of the buoy and in intimate contact with the bottom section 40 of styrofoam is an anchor deck 52 formed from a single circular plate of lightweight metal as is similarly utilized in the antenna deck 50. As earlier mentioned the antenna deck 50 may be secured to the buoy in any convenient manner such as, for example, a bolt arrangement having attached at one end thereof the antenna deck 50 and running through both sections 38, 40, of styrofoam and secured at the other end thereof to the center of the anchor deck 52 and ultimately the anchor cable connection 19 as shown in FIG. 1. Operatively attached to the anchor deck 52 is the anchor 36 with a portion of the third section 34 of the cable shown attached to the anchor. The anchor 36 is secured to the anchor deck 52 by means of an anchor support bracket 54 and a release pin 56. A torsion spring mount 58 and pivot bracket 60 form a portion of an automatic anchor release mechanism which will be described hereinafter with greater detail.

Figure 3:
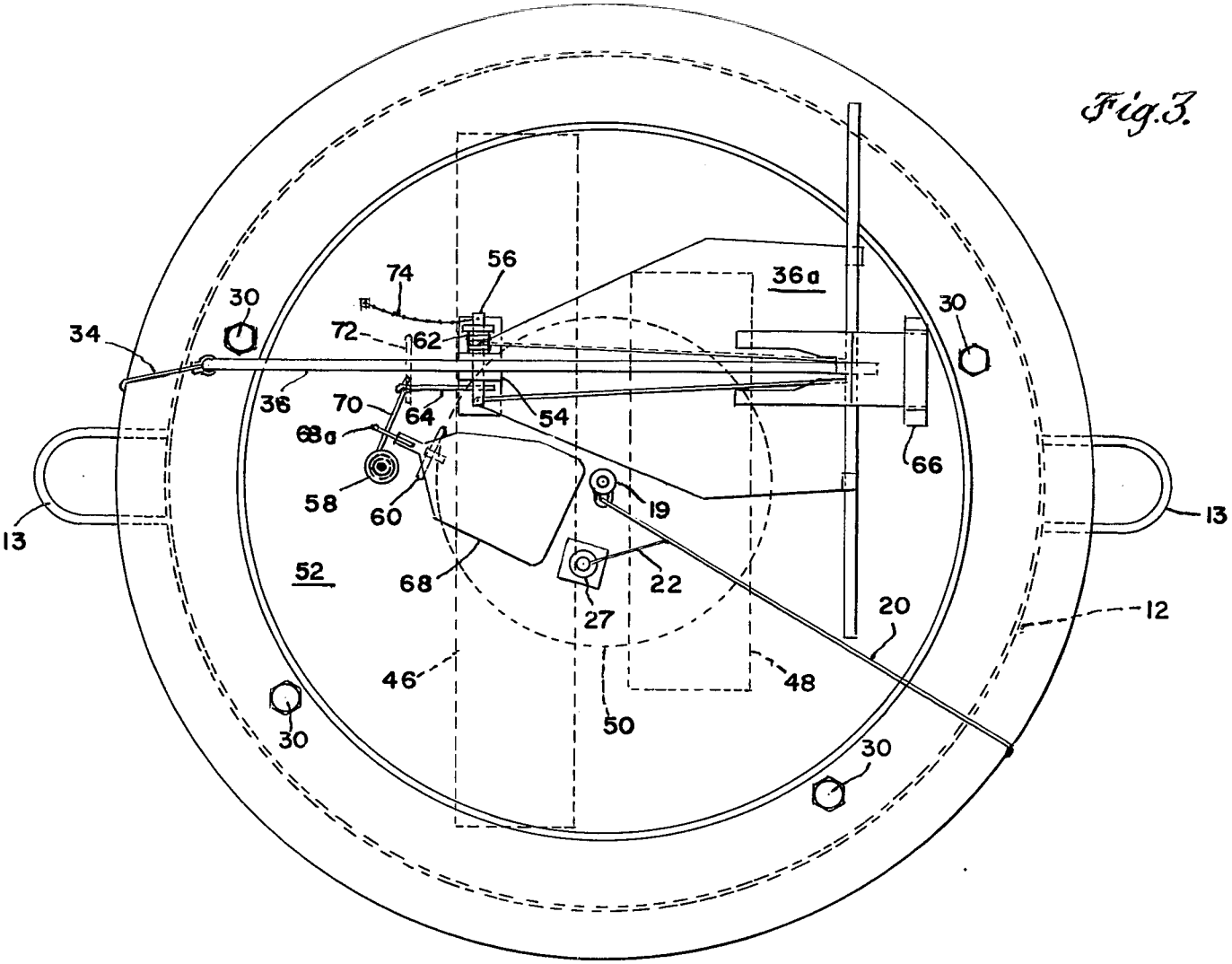
FIG. 3 is a bottom view of the invention as shown in FIG. 2.

Referring now to FIG. 3 there is shown a bottom view of the buoy with the anchor deck 52 and anchor release mechanism. The bottom flange of the circular shroud 12 is now clearly shown with the attaching bolts 30 spaced about the inner periphery of the flange. The retrieving hooks 13 are formed as loops diametrically opposed about the outer periphery of the spool shroud 12 and are conveniently sized so as to be grasped by the human hand for easy deployment when tossing the buoy over the side of a boat or, alternatively, for ready retrieval by a grappling hook. At the bottom of the buoy and secured to the center of the anchor deck is the anchor cable connection 19 shown with a portion of the first section 20 of the triple section cable extending from the cable connection 19 outwardly to the outer perimeter of the spool where winding of the triple section cable begins. Also shown near the center of the anchor deck is the hydrophone cable connection 21 which connects with the sensor cable 22 shown joining with the nylon braid 20. Interior to the buoy and encased within the styrofoam sections 38, 40 are shown the electronics package 46 which is connected to the hydrophone cable connection 21 and the antenna 16 in any convenient manner, and the battery package 48. The anchor 36 is now more clearly shown as having a fluke **36*a* at one end of the anchor and attached at the other end thereof is the third section 34 of the cable which is brought in from the spool shroud 12. In the stowage position the release pin 56 extends through a hole drilled through the support bracket 54 and into a concentrically aligned hole within the midportion of the shank of the anchor 36. A compression spring 62 is spirally wrapped about the pin 56 so as to urge the pin 56 to disengage from both the anchor 36 and the support bracket 54. On assembly, the pin 56 is inserted through the bracket 54 and anchor 36 against the compression of the spring 62 and is pinned in the stowage position by a retaining pin 64 which is inserted in a hole diametrically drilled through the end of the release pin 56. The anchor 36 is further secured near its fluke 36*a* end by a loose fitting bracket strap 66 attached at the ends thereof to the anchor deck 52. A release plate 68 formed in the shape of a paddle is hinged off-center about the pivot bracket 60 and has an L-shaped rigid wire 68*a* secured at one end of the plate 68. The wire 68*a* pivotally engages a torsion spring 70 which is spirally wound at one end about the mount 58 and at the other end engages an eyelet formed at the end of the retaining pin 64. A safety pin 72 is inserted through a hole in the shank of the anchor 36 and also engages the retaining pin 64 through the eyelet thereof. A retaining chain 74 is attached at one end to the anchor link 52 and at the other end is secured to the release pin 56.**

Figure 4:
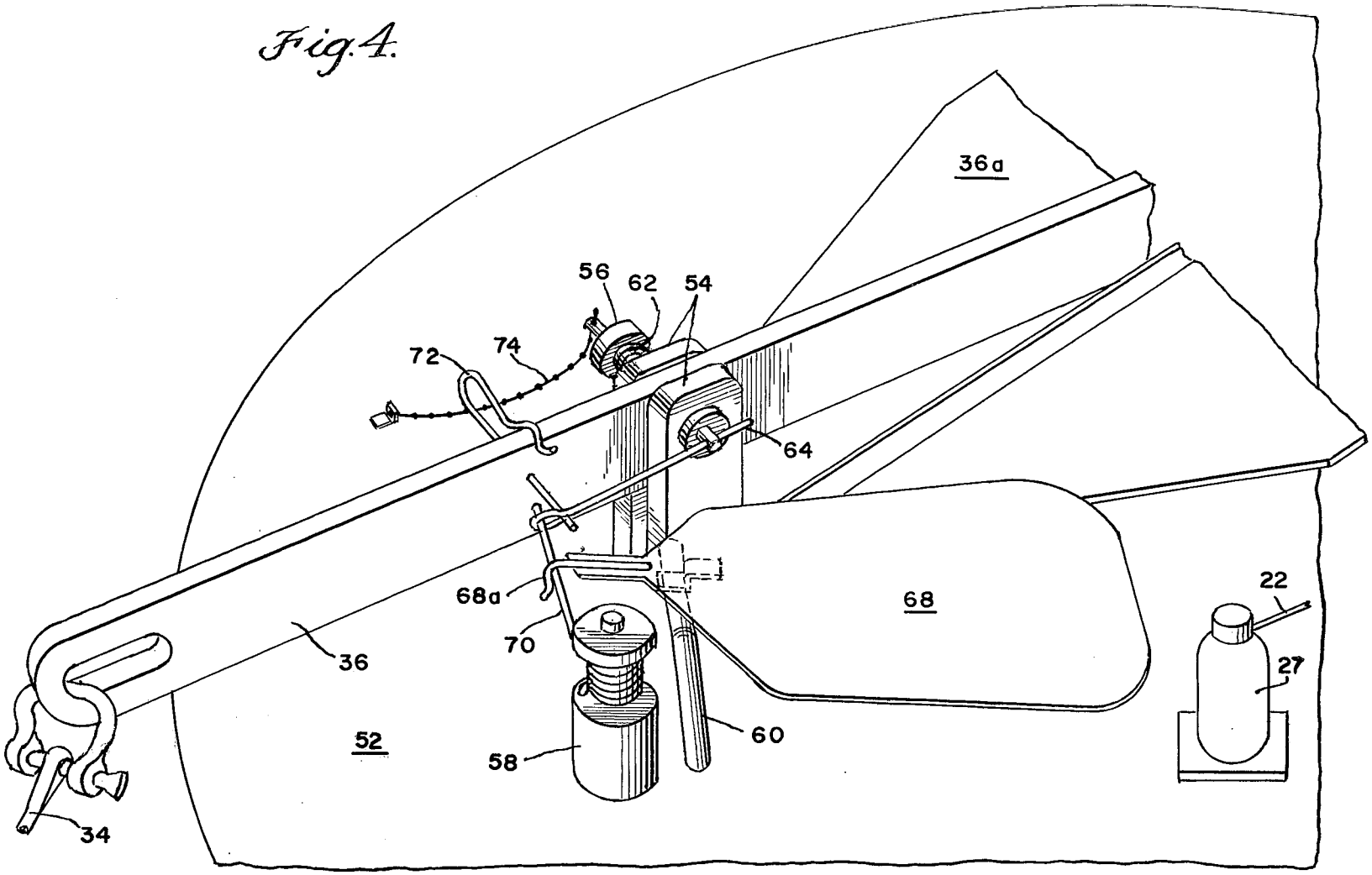
FIG. 4 is a magnified view of a portion of the invention as shown in the bottom view of FIG. 3.

Referring now to FIG. 4 there is shown a magnified view of a portion of the anchor deck 52 with the automatic anchor release structure in greater detail.

The release plate 68 is shown pivotally hinged about the pivot bracket 60 and the wire **68*a* is shown as securing the torsion spring 70 which is spirally wound at one end about the mount 58 and at the other end engages the eyelet of the retaining pin 64. The safety pin 72 is now more clearly shown as being inserted through a hole in the shank of the anchor 36 and engaging the eyelet of the pin 64. The retaining chain 74 is shown attached at one end to a point on the anchor deck 52 and at the other end is attached to the release pin 56.**

The pin 56 is shown inserted through the support bracket 54 and the shank of the anchor 36 thereby securing the anchor in the stowage position.

The operation of the invention will now be explained with particular reference to FIG. 4 and also FIGS. 1 and 2. As mentioned hereinbefore, FIG. 2 illustrates the stowage position of the present invention with the anchor 36 secured to the anchor deck 52 and with the hydrophone and support cable circularly wrapped and stored upon the spool shroud 12. The shape and design of the buoy is intended to be easily handled and deployed by a single operator and, accordingly, in one embodiment, for example, the spool shroud 12 is approximately 24 inches in diameter and 6 inches high with the antenna 16 extending approximately two feet in height from the antenna deck 50. For light weight, the spool shroud 12 may be formed, for example, from ⅛ inch aluminum stock. The electronics package 46 and the battery package 48 are also formed from lightweight aluminum tubing and are each sealed at both ends for waterproofing. Each tube is approximately 3 inches in diameter with the electronics package 46 being approximately 18 inches long and the battery package 48 being approximately 10 inches long. It is intended that the moored buoy be typically deployed by grasping the spool shroud 12 about the retrieval hooks 13 and throwing the entire moored buoy system 10 over the side of the boat in such a manner that the release plate 68 and associated anchor release structure first strike the water body so as to generate an impact force on the release plate 68 which is hinged off-center about the pivot bracket 60 to tilt and disengage the rigid wire 68*a* from the torsion spring 70. The release plate 68 then falls free and the torsion spring 70 returns to its rest position while concurrently pulling the retaining pin 64 from the eye of the release pin 56. The compression spring 62 on the release pin 56 returns to its rest position and forces the release pin 56 from the bracket 54 and the anchor 36. The anchor 36 falls free from the brackets 54 and 66 and places a downward force on the triple section cable 20, 23, 34. The downward force caused by the weight of the descending anchor causes the spool shroud 12 to rotate as the cable unwinds from the spool. As an aid to storing the cable in its proper position on the spool shroud 12 during stowage and to facilitate the proper sequence of cable payout during deployment, the cable may be held in place on the spool by a conventional thin rubber solution of binding material. The cable continues to unwind from the rotating spool shroud 12 until the anchor 36 reaches the bottom 28 of the water body. The fluke 36*a* of the anchor 36 sets itself in the bottom as wind and water forces on the cable and buoy exert a pulling action on the anchor 36. As shown in FIG. 1, the float package 26 imparts a certain measure of buoyancy to the hydrophone package 24, thus insuring that the hydrophone package does not lie upon the bottom 28 of the water body and thereby impair signal sensing. Any signals of interest to which the hydrophone package 24 is tuned are then relayed via the hydrophone cable 22 to the electronics package 46 within the buoy and ultimately transmitted to a monitoring station via the antenna 16.

Thus it may be seen that there has been provided a novel moored buoy sensor system deployable by one operator and having an automatic release mechanism which conveniently begins to deploy an anchor upon initial water impact.

Obviously many modifications and variations of the invention are possible in light of the above teachings. For example, the shroud spool could be molded plastic and made to jettison after cable deployment thus reducing weight and drag in the water, and other electronics such as small weather stations, radio relays, or fish finders could be housed and anchored with this device. It is therefore to be understood that within the scope of the appended claims the invention may be practiced otherwise than as specifically described.

What is claimed is:

1. An automatically deployable moored buoy comprising, in combination:

floatable housing means having mounted therein a float material;

an antenna attached to one side of said housing means;

an anchor releasably attached to another side of said housing means opposite to said one side thereof;

cable means having one end attached to said other side of said housing means, the other end attached to said anchor, and formed to be wound about the outer periphery of said housing means when said anchor is attached thereto; and release means including a spring-loaded release pin having an eyehole at one end thereof and connected to engage the shank of said anchor with said housing means, said release pin being urged to disengage from said anchor and said housing means by the spring, a retaining pin having one end inserted into said eyehole for holding said release pin in an engaged position with said anchor and said housing means and having an eyelet formed at the other end thereof, spring means connected at one end to said housing means and torsionally connected at the other end to said eyelet so as to urge said retaining pin from said release pin eyehole and trigger means pivotally connected to said housing means and frictionally connected to engage said other end of said spring means and for disengaging from said spring means upon water impact;

whereby said trigger means disengagement releases said spring means which pulls said retaining pin from said release pin thereby releasing said anchor from said housing means and causing said cable to unwind therefrom.

2. An automatically deployable moored buoy according to claim 1 wherein said release means further comprises:

a safety pin inserted through a hole in said shank and engaging said eyelet of said retaining pin for preventing the release of said anchor when in a stowage position on the buoy.

3. An automatically deployable moored buoy according to claim 1 wherein said trigger means further comprises:

bracket means attached to said housing means and extending therefrom to form a pivot; and a release plate pivotally mounted to said bracket means on said pivot and having a rigid wire extension formed to be frictionally connected to said spring means.

4. An automatically deployable moored buoy according to claim 3 wherein said bracket means pivot is positioned off-center of said release plate and toward said wire extension thereof.

5. An automatically deployable moored buoy according to claim 4 wherein said cable means is formed and fixed about said housing means by a rubber solution.

6. An automatic anchor release mechanism for a shallow water moored buoy comprising, in combination:

a floatable housing having a spool formed about the periphery thereof;

a mounting deck secured to the bottom of said housing;

an anchor having a shank releasably attached by said shank to said mounting deck; a cable having one end attached to said mounting deck, the other end attached to said anchor, and formed to be wound about said spool when said anchor is attached to said deck;

a spring-loaded release pin having an eyehole at one end thereof and connected to engage said shank of said anchor with said deck, said release pin being urged to disengage from said anchor and said deck by the spring;

a retaining pin having one end inserted into said eyehole for holding said release pin in an engaged position with said anchor and said deck and having an eyelet formed at the other end thereof;

spring means connected at one end to said deck and torsionally connected at the other end to said eyelet so as to urge said retaining pin from said release pin eyehole; and trigger means pivotally connected to said deck and frictionally connected to engage the other end of said spring means and for disengaging from said spring means upon water impact;

whereby said trigger means disengagement releases said spring means which pulls said retaining pin from said release pin thereby releasing said anchor from said deck and causing said cable to unwind from said spool.

7. An automatic anchor release mechanism according to claim 6 wherein the combination further comprises a safety pin inserted through a hole in said shank and engaging said eyelet of said retaining pin for preventing the release of said anchor when in a stowage position on the buoy.

8. An automatic anchor release mechanism according to claim 6 wherein said trigger means further comprises:

bracket means attached to said deck and extending therefrom to form a pivot; and a release plate pivotally mounted to said bracket means on said pivot and having a rigid wire extension formed to be frictionally connected to said spring means.

9. An automatic anchor release mechanism according to claim 8 wherein said bracket means pivot is positioned off-center of said release plate and toward said wire extension thereof.

10. An automatic anchor release mechanism according to claim 9 wherein said cable is formed and fixed about said spool by a rubber solution.

* * * * *